US005298133A

United States Patent [19]

Heavens

[11] Patent Number: 5,298,133

[45] Date of Patent: Mar. 29, 1994

[54] METHOD OF RECYCLING ORGANIC LIQUIDS AND A METHOD OF MANUFACTURING ARTICLES BY ELECTROPHORETIC DEPOSITION

[75] Inventor: Stephen Heavens, Saughall, Great Britain

[73] Assignee: Chloride Silent Power Limited, Runcorn, Great Britain

[21] Appl. No.: 474,140

[22] PCT Filed: Dec. 2, 1988

[86] PCT No.: PCT/GB88/01074

§ 371 Date: Jun. 28, 1990

§ 102(e) Date: Jun. 28, 1990

[87] PCT Pub. No.: WO89/05364

PCT Pub. Date: Jun. 15, 1989

[30] Foreign Application Priority Data

Dec. 3, 1987 [GB] United Kingdom ..... 8728300

[51] Int. Cl.[5] ..... C25D 13/00

[52] U.S. Cl. ..... 204/180.8; 204/181.2

[58] Field of Search ..... 204/181.2, 180.8

[56] References Cited

U.S. PATENT DOCUMENTS 3,067,120 12/1962 Pearlstein ..... 204/181
4,366,049 12/1982 Knorre ..... 208/179
4,542,114 9/1985 Hegarty ..... 208/106

FOREIGN PATENT DOCUMENTS 979948 1/1965 United Kingdom .

OTHER PUBLICATIONS

Amer. Ceram. Soc. Bull. 65[9] 1270–77 (1986) "Ceramic Aspects of Forming Beta Alumina by Electrophoretic Deposition" by Robert Powers.

*Primary Examiner*—John Niebling
*Assistant Examiner*—Arun S. Phasge
*Attorney, Agent, or Firm*—Finnegan, Henderson, Farabow, Garrett & Dunner

[57] ABSTRACT

Organic carrier liquids used in electrophoretic deposition have to be recycled for economic and environmental reasons. This specification disclosed recycling using the separate steps of de-ionizing and drying the carrier liquid to provide fresh carrier liquid.

23 Claims, 1 Drawing Sheet

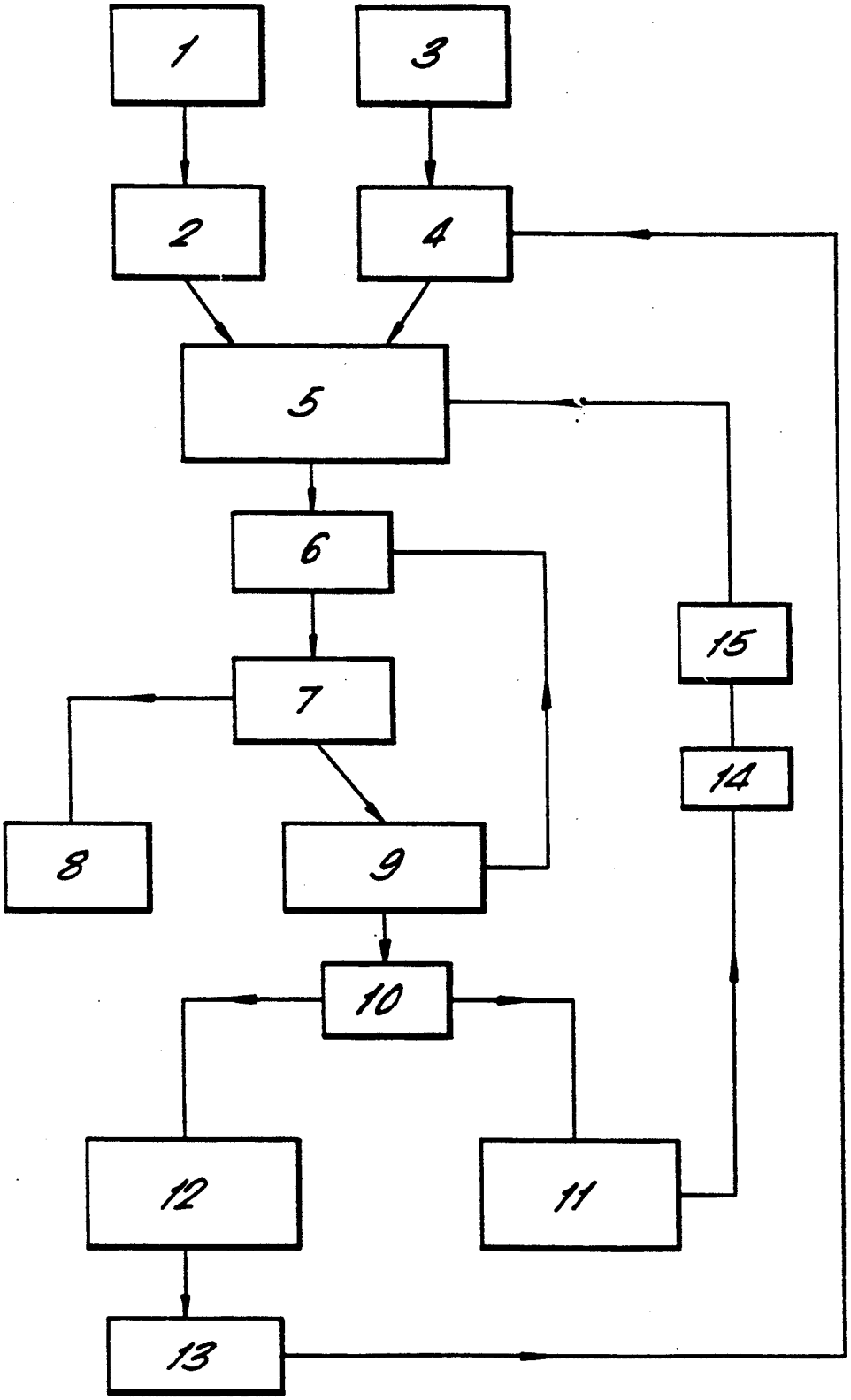
1
3
2
4
5
6
15
7
14
8
9
10
12
11
13

METHOD OF RECYCLING ORGANIC LIQUIDS AND A METHOD OF MANUFACTURING ARTICLES BY ELECTROPHORETIC DEPOSITION

FIELD OF THE INVENTION

This invention relates to a method of recycling organic liquids and method of manufacturing articles by electrophoretic deposition.

DESCRIPTION OF THE PRIOR ART

In electrophoretic deposition a suspension of electrically charged particles in a carrier liquid, hereinafter referred to as a slurry, is passed between a pair of electrodes. One of the electrodes serves as a mandrel to which the particles are attracted and pressed to form an article.

Electrophoretic deposition processes are well known for use for a variety of purposes, one such purpose being the manufacture of the beta alumina electrolyte cup as used in sodium-sulphur electrochemical cells. In such a process a liquid medium is used for suspending the particles, that is the beta alumina particles, to be deposited, and it is desirable for such liquid medium to be either cheap so that re-use is not necessary, or reclaimable for re-use to save expenditure.

Water has been proposed as a cheap liquid medium but is not generally satisfactory since electrolysis of the water occurs during the electrophoretic deposition process, this resulting in the production of gaseous products which result in void-like defects in the article built-up from the deposited particles. This is clearly undesirable for the strength of the article.

Thus, organic liquids are preferred as the liquid medium since gassing is considerably reduced with such liquids. Reclamation of the liquid medium is, however, essential for economic and environmental reasons.

In principle an organic liquid medium can be reclaimed after use in an electrophoretic deposition process simply by allowing or causing the used suspension to separate into solid and liquid phases and then decanting off the supernatant liquid.

Drying of the supernatent liquid can then be effected by passage through a molecular sieve. Reference to this method may be found in the article by Robert W. Powers in the Am. Ceram. Soc. Bull., 65[9]1270-77 (1986) entitled "Ceramic Aspects of Forming Beta Alumina by Electrophoretic Deposition". Drying is required since the presence of water in the reclaimed organic liquid beyond about 0.03% will seriously affect any electrophoretic deposition process carried out using the reclaimed liquid by reversing the charge on the particles suspended therein. One of the particular problems faced when using beta alumina is that the particles require negative charging. The prescence of even very small quantities of water is therefore a problem since the beta alumina is extremely hydroscopic and any hydrogen ions will of course disrupt the charge status.

However, attempts to reuse an organic liquid reclaimed in such a way have proved to be unsuccessful, and it is thought that this is due to chemical changes which occur in the organic liquid in the electrophoretic deposition process. In an electrophoretic deposition process the suspension of the particles to be deposited in the organic liquid may be vibro-milled to charge the particles as necessary, and during such operation the conductivity of the organic liquid rises, possibly due to ionic dissociation from the particles. This rise in conductivity is not removed if the organic liquid is reclaimed by the method mentioned above, and thus if such a reclaimed organic liquid is reused, the new particles added thereto will not become adequately charged during the vibro-milling operation, and the suspension produced will not be suitable for an electrophoretic deposition process.

STATEMENT OF THE INVENTION

Thus, in accordance with the present invention, a method of reclaiming an organic liquid used as the suspending medium in an electrophoretic deposition process, comprises the steps of separately de-ionising the used liquid and then removing water from the de-ionised liquid.

Consequently, the invention is predicated on the appreciation of the deficiencies in previous approaches to recycling organic liquids. Preferably, de-ionising is effected by distillation, which can be carried out using a conventional single-stage Liebig condenser or solvent recovery plant. It has been found that the distilled liquid then has a conductivity close to that of the original liquid.

The step of removing water from the distilled liquid can be carried out by passing the distilled liquid through a molecular sieve.

Molecular sieves can be used not only to remove water but also to reduce the conductivity of an organic liquid passed therethrough. However, if used to reduce the conductivity it is necessary for the used organic liquid to be exposed to the sieves for a long time, say two to three weeks, and such extended use of the sieves reduces their efficiency. Further, while such sieves can be regenerated by heating to remove absorbed water, the removal of, for example, absorbed ions is very difficult and the sieves become saturated and inefficient.

With a method in accordance with the invention the molecular sieves are used only to remove absorbed water, and thus can be regenerated by heating and used many times while remaining efficient.

The choice of organic liquid is made from a group of organic liquids each having suitable values of properties such as dielectric constant, electrical conductivity, toxicity, flammability, cost and odour. The essential property is that the dielectric constant should fall within the range of 10–20. Amyl alcohol is a preferred organic liquid for use for electrophoretic deposition processes since it has particularly acceptable values of these variables.

A further problem associated with known techniques of electrophoretic deposition is that when a concentrated slurry is used to manufacture a thin walled article the yield is low because only a small fraction of the powder in the slurry is deposited on the mandrel, the remainder being discarded in the residual slurry remaining after deposition is completed.

It has been proposed to increase the yield by using one batch of slurry for more than one deposition operation. However, such a method is not convenient because the time needed for deposition may have to be longer for each subsequent deposition due to the reduced concentration of the slurry; it is inconvenient in commercial operations to have to adjust the deposition time and a point is reached where no deposition occurs because of the weak concentration of the slurry.

In a further aspect of the invention, a method of manufacturing articles by electrophoretic deposition, comprising passing a slurry of particles in a carrier liquid between a pair of electrodes, one of which serves as a mandrel on which the particles are deposited to form an article, further comprises separating at least some of the residual slurry, which is slurry which has passed between the electrodes, into recovered powder and recoved carrier liquid and recycling the recovered carrier liquid by the steps of de-ionising and then drying the de-ionised carrier liquid to provide fresh carrier liquid and then adding a powder of particles to the fresh carrier liquid to provide fresh slurry. The added powder may be recovered powder, fresh powder, or a combination of the two. When recovered powder alone is used, the particles of the powder are preferably given the requisite charge by providing a further step of ionic adsorption. When a mixture of recovered and fresh powder is used, the mixture may preferably be milled to provide the requisite charging. Milling is continued for a time determined to provide an optimum mean particle size. The charging techniques may be interchanged. Conveniently, fresh slurry may also be added to unseparated residual slurry in the ratio of between 1:3 and 3:1, the mixture then being passed between the electrodes for further deposition. The fresh slurry is conveniently made up from recycled carrier liquid.

Preferably the residual slurry is mixed with fresh slurry in the ratio of 1:1.

BRIEF DESCRIPTION OF THE DRAWINGS

This invention will now be described by way of example with reference to the drawing which is a flow chart illustrating the method of the invention.

DETAILED DESCRIPTION

The method to be described is used for the manufacture of beta alumina bodies as used as solid electrolyte bodies in sodium-sulphur electrochemical cells.

For such manufacture, raw beta alumina powder 1 is suspended, after treatment 2, in an organic carrier liquid 3, such as amyl alcohol which has been dried using molecular sieves 4, to form a fresh slurry 5. Molecular sieves work by allowing internal adsorption of water molecules within the pore structure, the minimum projected cross section of the carrier liquid molecule being greater than the pore size so that the carrier liquid molecule is excluded. In the case of amyl alcohol as the carrier liquid, a pore size of 0.4 nm has been used. It will be appreciated that the specific choice of sieve pore size will therefore depend on the choice of organic carrier liquid. The slurry is then milled as at 6 to obtain the necessary charging and particle size for the powder, and is then fed to an electrophoretic deposition cell 7 for deposition to occur in a known manner. Articles produced in the cell 7 are removed as shown at 8.

After a deposition operation residual slurry 9 from the cell 7 is returned to the mill 6 for mixing with fresh slurry for supply to the cell 7, the ratio of residual slurry to fresh slurry in the mixture being 1:3 to 3:1. Other residual slurry is separated as at 10 by gravity or centrifugal separation, into recovered powder 11 and recovered carrier liquid 12 components. Recovered carrier liquid is distilled as at 13 and the condensate, free of ionic impurities, is then returned to the molecular sieves 4 for reuse. Recovered powder 11 is dryed as at 14 and de-agglomerated as at 15 before being reused for the preparation of fresh slurry 5. The recovered powder drying stage 14 can be a two-stage operation, these being a first relatively low temperature stage during which carrier liquid is removed, and a second relatively high temperature stage during which water is removed. Further water removal has been found necessary in practice when using powder material of extreme hydroscopicity, such as beta alumina. The recovered powder, after drying can be used in the ratio of 1:3 to 3:1 with fresh powder for fresh slurry preparation. When recovered powder is used as fresh slurry preparation the time of milling at 6 is reduced in order to compensate for the relatively small particle size of the recovered powder.

If necessary the fresh suspension can be de-gassed as by vacuum or ultrasonic agitation before being fed to the cell 7 in order to further reduce the possibility of the presence of gas bubbles in the article deposited in the cell 7.

I claim:

1. A method of treating an organic liquid which has been used as a carrier liquid in an electrophoretic deposition process, the method comprising the separate steps of:

first de-ionising the used liquid; and then removing water from the de-ionised liquid;

wherein the treated liquid can be re-used as a carrier liquid in an electrophoretic deposition process.

2. The method as claimed in claim 1, wherein the step of de-ionising the used liquid is effected by the step of distilling the used liquid.

3. The method as claimed in either claim 1 or claim 2, wherein the step of removing water from the de-ionised liquid is effected by the step of passing the de-ionised liquid through a molecular sieve.

4. The method as claimed in claim 3, wherein the organic liquid is selected from a group of organic liquids each having a dielectric constant in the range of 10–20.

5. The method as claimed in claim 4, wherein the organic liquid is amyl alcohol.

6. The method as recited in claim 1, wherein the electrophoretic deposition process is a beta alumina electrophoretic deposition process.

7. The method as claimed in claims 1 or 2, wherein the organic liquid is selected from a group of organic liquids each having a dielectric constant in the range of 10 to 20.

8. The method as claimed in claim 7, wherein the organic liquid is amyl alcohol.

9. A method of manufacturing articles by electrophoretic deposition, the method comprising the steps of:

preparing a slurry of particles suspended in a carrier liquid; and passing the slurry between a pair of electrodes, one of the electrodes serving as a mandrel on which the particles are deposited to form an article, said step of preparing the slurry comprising the steps of:

separating at least some of the slurry which has passed between the electrodes into recovered powder and recovered carrier liquid;

treating the recovered carrier liquid by the steps of first de-ionising the recovered carrier liquid, and then drying the de-ionised carrier liquid to provide treated carrier liquid; and adding powder to the treated carrier liquid to provide fresh slurry.

10. The method as claimed in claim 9, wherein the added powder is recovered powder, fresh powder, or a combination of recovered powder and fresh powder.

11. The method as claimed in claim 10, wherein, when the added powder is recovered powder, the method further includes the step of ionically adsorping the added powder.

12. The method as claimed in claim 10, wherein, when the added powder is fresh powder or a combination of fresh powder and recovered powder, the method further includes the step of milling the added powder for a predetermined time to yield charged particles of an optimum means size.

13. The method as claimed in any one of claims 9–12, further including the steps of adding fresh slurry to the residual slurry in a ratio of between 1:3 and 3:1, and passing the fresh slurry and residual slurry between the electrodes for deposition.

14. The method as claimed in any one of claims 9–12, wherein the step of separating the residual slurry into recovered powder and recovered carrier liquid is effected by either the step of gravity settling or centrifugally separating the recovered powder from the carrier liquid.

15. The method as claimed in any one of claims 9–12, further including the step of de-gassing the slurry before the slurry is passed between the electrodes.

16. The method as claimed in any one of claims 9–12, further including the step of drying the recovered powder, the step of drying the recovered powder includes a first stage during which carrier liquid is removed from the recovered powder and a second stage during which water is removed from the recovered powder.

17. The method as recited in claim 9, wherein the electrophoretic deposition process is a beta alumina electrophoretic deposition process.

18. The method as claimed in claim 9, wherein the step of de-ionising the recovered liquid is effected by the step of distilling the recovered liquid.

19. The method as claimed in either claim 9 or claim 17, wherein the step of removing water from the de-ionised liquid is effected by the step of passing the de-ionised liquid through a molecular sieve.

20. The method as claimed in claim 18, wherein the organic liquid is selected from a group of organic liquids each having a dielectric constant in the range of 10–20.

21. The method as claimed in claim 20, wherein the organic liquid is amyl alcohol.

22. The method as claimed in claim 19, wherein the organic liquid is selected from a group of organic liquids each having a dielectric constant in the range of 10–12.

23. The method as claimed in claim 22, wherein the organic liquid is amyl alcohol.

* * * * *

UNITED STATES PATENT AND TRADEMARK OFFICE

CERTIFICATE OF CORRECTION

PATENT NO. : 5,298,133

DATED : March 29, 1994

INVENTOR(S) : Stephen HEAVENS

It is certified that error appears in the above-indentified patent and that said Letters Patent is hereby corrected as shown below:

Claim 12, column 5, line 10, change "means" to --mean--.

Claim 19, column 6, line 11, change "17" to --18--.

Claim 22, column 6, line 24, change "10-12" to --10-20--.

Signed and Sealed this

Twelfth Day of July, 1994

Bruce Lehman

*Attest:*

BRUCE LEHMAN

*Attesting Officer*

*Commissioner of Patents and Trademarks*